US009414633B2

(12) United States Patent
Giroux Bernier et al.

(10) Patent No.: US 9,414,633 B2
(45) Date of Patent: Aug. 16, 2016

(54) HELMET MOUNTING SYSTEM

(71) Applicant: Revision Military S.a.r.L., Luxembourg (LU)

(72) Inventors: Dominic Giroux Bernier, Montreal (CA); Stéphane Lebel, St. Redempteur (CA); Marie-Pierre Gendron, Mercier (CA)

(73) Assignee: Revision Military S.a.r.L., Luxembourg (LU)

( * ) Notice: Subject to any disclaimer, the term of this patent is extended or adjusted under 35 U.S.C. 154(b) by 0 days.

(21) Appl. No.: 14/314,117

(22) Filed: Jun. 25, 2014

(65) Prior Publication Data

US 2015/0026872 A1 Jan. 29, 2015

Related U.S. Application Data

(60) Provisional application No. 61/840,229, filed on Jun. 27, 2013.

(51) Int. Cl.

| | |
|---|---|
| ***A42B 3/04*** | (2006.01) |
| ***A42B 3/00*** | (2006.01) |
| ***A42B 1/24*** | (2006.01) |
| ***A42B 3/30*** | (2006.01) |

(52) U.S. Cl.

CPC ..... *A42B 3/0406* (2013.01); *A42B 1/24* (2013.01); *A42B 3/00* (2013.01); *A42B 3/04* (2013.01); *A42B 3/30* (2013.01); *Y10T 29/49826* (2015.01)

(58) Field of Classification Search

CPC ..... A42B 3/04; A42B 3/0406; A42B 3/30; A42B 3/00; A42B 3/227; A42B 1/24

USPC ..... 2/422, 421, 6.2, 6.3

See application file for complete search history.

(56) References Cited

U.S. PATENT DOCUMENTS

| | | | | |
|---|---|---|---|---|
| 575,221 | A * | 1/1897 | Eisenbeis | 2/7 |
| 4,601,070 | A | 7/1986 | Sargentini | |
| 4,605,000 | A | 8/1986 | Anguita | |
| 5,265,276 | A | 11/1993 | Kimberly | |
| 5,914,816 | A | 6/1999 | Soto et al. | |
| 6,438,760 | B1 | 8/2002 | Wakefield et al. | |
| 6,457,179 | B1 * | 10/2002 | Prendergast | 2/6.2 |
| 6,472,776 | B1 * | 10/2002 | Soto et al. | 307/400 |
| 6,497,493 | B1 | 12/2002 | Theisen | |
| 6,662,370 | B1 * | 12/2003 | Buchanan, Jr. | A42B 3/04 2/422 |
| 6,751,810 | B1 | 6/2004 | Prendergast | |
| 6,811,348 | B1 * | 11/2004 | Meyer et al. | 403/325 |
| 6,820,285 | B2 | 11/2004 | Bataille et al. | |

(Continued)

OTHER PUBLICATIONS

U.S. Appl. No. 13/563,596, filed Jul. 31, 2012, Lebel et al.

*Primary Examiner* — Shaun R Hurley
*Assistant Examiner* — Bao-Thieu L Nguyen
(74) *Attorney, Agent, or Firm* — Wolf, Greenfield & Sacks, P.C.

(57) ABSTRACT

Systems and methods for attaching an accessory to a helmet. A helmet accessory mounting interface may be attached to a receptacle. The receptacle may be removably or permanently received by a carrier. The carrier may be attached to a helmet having a particular shape and size. The carrier also may be configured to receive any selected type of a plurality of receptacle types which, in turn, corresponds to a particular mounting interface for a helmet accessory. The receptacle may be receivable, in some embodiments removably, by any one of a number of different types of carriers.

23 Claims, 15 Drawing Sheets

(56) References Cited

U.S. PATENT DOCUMENTS

| | | | | |
|---|---|---|---|---|
| 6,938,276 | B1 | 9/2005 | Prendergast | |
| 7,219,370 | B1 | 5/2007 | Teetzel et al. | |
| 7,444,683 | B2 | 11/2008 | Prendergast et al. | |
| 7,805,776 | B2 * | 10/2010 | Crossman et al. | 2/424 |
| D638,168 | S * | 5/2011 | Lebel et al. | D29/107 |
| 7,963,426 | B2 | 6/2011 | Gruebel et al. | |
| 8,238,045 | B2 | 8/2012 | Prendergast et al. | |
| 8,337,036 | B2 * | 12/2012 | Soto et al. | 362/105 |
| 8,375,473 | B2 * | 2/2013 | Celona et al. | 2/422 |
| 8,661,571 | B1 * | 3/2014 | Teetzel et al. | 2/422 |
| 8,739,313 | B2 * | 6/2014 | Teetzel et al. | 2/6.6 |
| 2004/0003453 | A1 * | 1/2004 | Urakawa et al. | 2/422 |
| 2008/0184462 | A1 * | 8/2008 | Prendergast | 2/410 |
| 2008/0263752 | A1 | 10/2008 | Solinsky et al. | |
| 2009/0038056 | A1 | 2/2009 | Bobbin et al. | |
| 2009/0049585 | A1 * | 2/2009 | Borsa et al. | 2/422 |
| 2009/0077721 | A1 * | 3/2009 | Prendergast | 2/422 |
| 2009/0083890 | A1 * | 4/2009 | Dempsey et al. | 2/2.5 |
| 2010/0012692 | A1 * | 1/2010 | Harris et al. | 224/181 |
| 2010/0083413 | A1 * | 4/2010 | McGovern | 2/6.6 |
| 2010/0175172 | A1 * | 7/2010 | Dempsey et al. | 2/422 |
| 2010/0299814 | A1 | 12/2010 | Celona et al. | |
| 2011/0072562 | A1 * | 3/2011 | Prendergast | 2/422 |
| 2011/0113519 | A1 * | 5/2011 | Gendron et al. | 2/2.5 |
| 2011/0145981 | A1 * | 6/2011 | Teetzel et al. | 2/422 |
| 2011/0170280 | A1 | 7/2011 | Soto et al. | |
| 2012/0011631 | A1 * | 1/2012 | Crossman et al. | 2/2.5 |
| 2012/0090079 | A1 * | 4/2012 | Lebel et al. | 2/422 |
| 2012/0117717 | A1 * | 5/2012 | McGinn et al. | 2/424 |
| 2012/0317706 | A1 * | 12/2012 | Lebel et al. | 2/422 |
| 2013/0086722 | A1 * | 4/2013 | Teetzel et al. | 2/2.5 |
| 2013/0192029 | A1 | 8/2013 | Hall et al. | |
| 2013/0291290 | A1 * | 11/2013 | Bernier et al. | 2/422 |
| 2014/0000013 | A1 * | 1/2014 | Redpath et al. | 2/422 |
| 2014/0020159 | A1 * | 1/2014 | Teetzel et al. | 2/422 |
| 2014/0033406 | A1 | 2/2014 | Lebel et al. | |
| 2014/0075654 | A1 * | 3/2014 | McGinn et al. | 2/422 |
| 2014/0245523 | A1 * | 9/2014 | Teetzel et al. | 2/422 |
| 2015/0026872 | A1 | 1/2015 | Giroux et al. | |
| 2015/0135417 | A1 | 5/2015 | Lebel et al. | |
| 2015/0245682 | A1 | 9/2015 | McGinn et al. | |
| 2015/0282549 | A1 | 10/2015 | Lebel et al. | |
| 2015/0351482 | A1 | 12/2015 | Gendron et al. | |

* cited by examiner

HELMET MOUNTING SYSTEM

CROSS-REFERENCE TO RELATED APPLICATIONS

This application claims priority to U.S. Provisional Application No. 61/840,229, filed Jun. 27, 2013, entitled "HELMET MOUNTING SYSTEM," the entire contents of which is incorporated herein by reference in its entirety.

FIELD

Aspects described herein generally relate to helmet mounting arrangements and methods for attaching an accessory interface to a helmet.

DISCUSSION OF RELATED ART

Those who are at risk of exposure to trauma to the head (e.g., soldiers, emergency responders, law enforcement officers, military personnel, etc.) may wear protective headgear, such as a helmet. In some cases, it may be desirable for helmets to include an accessory, such as an illuminator, camera, video recorder, laser pointer, communications device, identification friend or foe (IFF) device, or other item, to aid the helmet wearer in the performance of duties while in the field. Such accessories may be removably attached to a helmet via a mounting plate.

SUMMARY

According to one embodiment, an apparatus for a helmet accessory mount is provided. The apparatus includes a carrier constructed and arranged to be attached to a helmet. The carrier includes a first arm and a second arm located opposite one another relative to a central region of the carrier, each arm extending in a respective direction away from the central region of the carrier; and a receptacle-receiving portion to removably receive a receptacle that is configured to hold a helmet accessory mounting interface.

According to another embodiment, a helmet accessory mount assembly is provided. The assembly includes a carrier constructed and arranged to be attached to a helmet, the carrier including a receptacle-receiving portion; a receptacle removably coupled to the receptacle-receiving portion of the carrier; and a helmet accessory mounting interface attached to the receptacle.

According to a further embodiment, a method of assembling a helmet accessory mount system is provided. The method includes attaching a helmet accessory mounting interface to a receptacle; and positioning the receptacle at a receptacle-receiving portion of a carrier, the carrier being attachable to a helmet.

According to yet another embodiment, an apparatus for a helmet accessory mount is provided. The apparatus includes a carrier constructed and arranged to be attached to a helmet. The carrier includes a hook located at a lower region of the carrier and having a surface configured to resist rotation of an upper region of the carrier in a direction away from the helmet; and a receptacle-receiving portion to removably receive a receptacle that is configured to hold a helmet accessory mounting interface.

According to another embodiment, a method of assembling a helmet accessory mount system is provided. The system includes a carrier which is attachable to a helmet and is configured to receive any type of receptacle from among a plurality of receptacle types, each type of receptacle being configured to receive a different type of helmet accessory mounting interface. The method includes (a) selecting a type of receptacle to associate with the carrier; and (b) attaching a receptacle of the selected receptacle type to the carrier.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. Various embodiments of the invention will now be described, by way of example, with reference to the accompanying drawings, in which.

DETAILED DESCRIPTION

The inventors have appreciated that it would be advantageous to construct a modular system for conveniently mounting a helmet accessory (e.g., a visor, night vision goggles, a camera, a communications device, etc.) to a helmet. A mount for a helmet accessory may include a carrier which is attachable to a helmet. The carrier may support, stabilize, hold or otherwise receive a receptacle. The receptacle, in turn, receives a helmet accessory mounting interface. The helmet accessory mounting interface provides mounting components for connection of the helmet accessory. In this manner, the receptacle may provide for attachment of the helmet accessory mounting interface to any suitable carrier. That is, the receptacle may permit connection of a helmet accessory mounting interface to any one of a variety of carriers, where each carrier may be structurally suited for attachment to a particular type and/or size of helmet. Similarly, a carrier may be capable of receiving any one of a variety of helmet accessory mounting interfaces by having the carrier be compatible with any one of a number of receptacles, where each receptacle is specifically tailored to a different type of accessory mount.

The carrier may be attached to a helmet, such as the front of the helmet or any other appropriate region (e.g., rear, side, top of the helmet, etc.). The carrier may include arms located on either side of a central region of the carrier where the arms extend in substantially opposite directions away from one another. The overall structure of the carrier including the arms may be a certain shape depending on the type and/or size of helmet to which the carrier is attached. Once attached to the helmet, the carrier, along with other components, may provide flexibility for a number of different types of accessories to be mounted to the helmet without requiring the carrier to be replaced. For instance, a carrier, while manufactured to be attached to a particular type and/or size of helmet, may be capable of receiving any of a number of different types of receptacles and/or mounting interfaces.

Helmet accessory mounting interfaces described herein may each correspond to one or more helmet accessories, such as visors, night vision goggles, infrared devices, cameras, etc. For example, a particular helmet accessory mounting interface may be structured as a mounting plate (e.g., metal plate, plastic plate) having certain features that are complementary to features of a corresponding accessory connector.

Receptacles, in turn, may each correspond to one or more helmet accessory mounting interfaces. For instance, a receptacle may exhibit a structure that is particularly suited to couple with a helmet accessory mounting interface (e.g., a mounting plate). The receptacle may couple with the mounting interface through one or more interference friction fits, slotted connections, snap fits, or other components.

Figure 1:
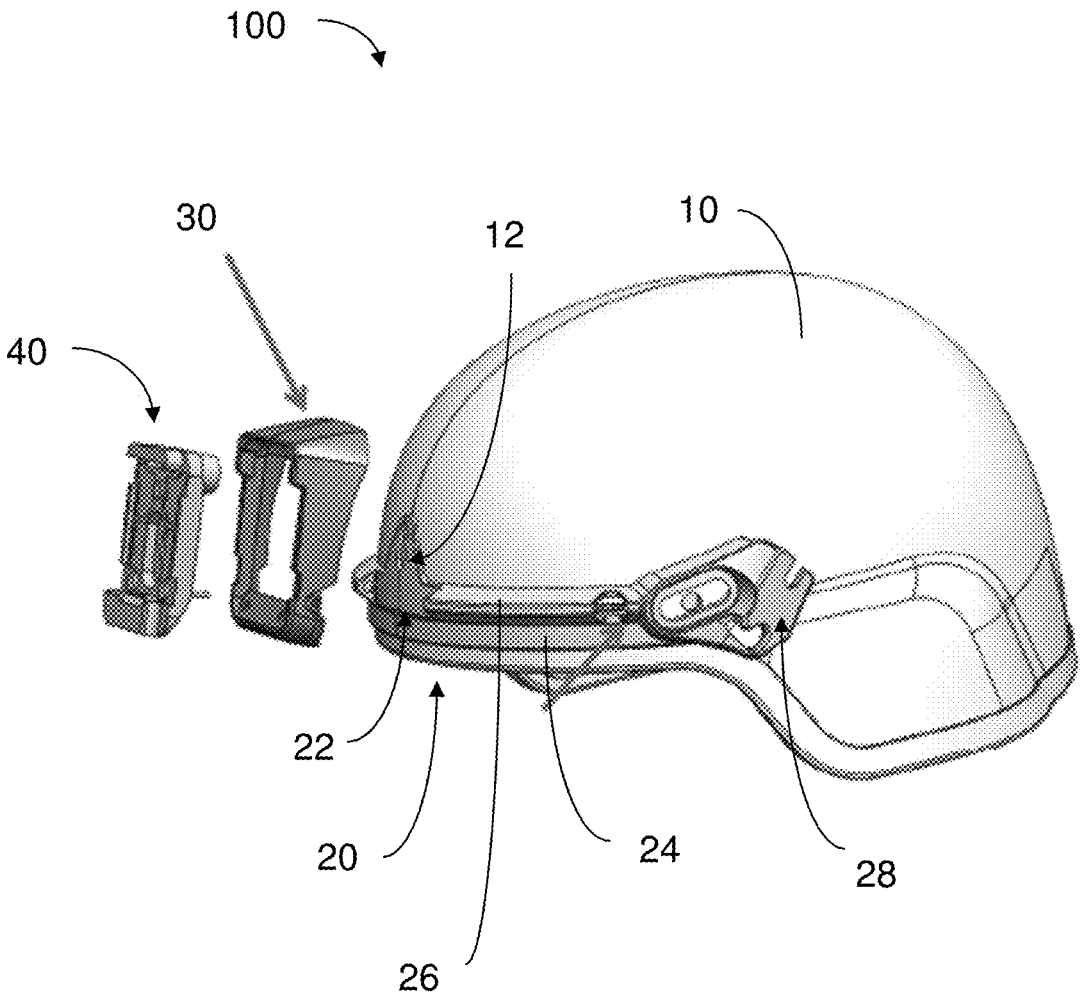
FIG. 1 is a perspective view of a helmet accessory mount assembly in accordance with some embodiments.

FIG. 1 shows a helmet accessory mount assembly 100 including a helmet 10 and a carrier 20 that is attached to the helmet. The helmet optionally includes an attachment hole 12, which may or may not be threaded, for insertion of a fastener (e.g., threaded screw, nut and bolt, etc.), allowing attachment of a helmet accessory mounting interface 40 and/or receptacle 30 to the helmet. The carrier includes a receptacle-receiving portion 22 located at a central region of the carrier, which may be structured to facilitate coupling and/or attachment of a receptacle 30 to the carrier. When coupled to the carrier, the receptacle may, at the same time, be attached to a helmet accessory mounting interface 40.

The carrier also may include arms 24 structured to conform to the contoured shape of the helmet and extending in respective directions away from a central region of the carrier. As described further below, the arms 24 optionally may include ridges 26 suitable to receive a portion of a receptacle 30. The carrier further optionally includes a mandible guard connector 28 to support connection of the carrier and helmet to a mandible guard in some embodiments.

As shown, the front of the carrier is attached at the front of the helmet and the arms 24, which are attached to the sides of the helmet, extend alongside the front rim. Accordingly, the carrier may be anchored to the helmet at multiple points. For instance, the carrier 20 shown in FIG. 1 is attached to the helmet at the middle and at the periphery of the carrier to result in a three-point anchoring system. However, it should be appreciated that carriers described herein may be attached at any suitable location on the exterior surface of the helmet.

The carrier may be attached in any suitable way to the helmet, such as via fastening or adhesion as two examples. A carrier may be attached to the helmet at a peripheral portion and/or a central portion. In some cases, the carrier may attach to a helmet in a manner that does not require hardware or fasteners. For example, the carrier may slidingly engage with a helmet such that the carrier can be slid on or off of the helmet. Or, the carrier and helmet may have complementary snap fit features that provide for a suitable attachment. Alternatively, a combination of fasteners, a sliding engagement and/or complementary features may be used to attach the carrier to a helmet. In some embodiments, attachment of the receptacle to the carrier may be performed without the use of tools. Further, the arms of the carrier may be structured so as to provide for stability of the helmet accessory when mounted to the helmet. The arms of the carrier may also provide a number of points of attachment for other components (e.g., mandible guard), to the helmet.

A user may receive a helmet and a carrier which may, or may not, already be joined together. The user may select an accessory that corresponds with a particular type of mounting interface. The mounting interface and a receptacle for the mounting interface are attached to or otherwise received by the carrier/helmet, and the accessory then may be attached to the mounting interface. Accordingly, the wearer may quickly and conveniently select a helmet accessory without having to replace the carrier.

In some embodiments, a receptacle is detachably received by the carrier such that a receptacle can be replaced without replacing the carrier. In other embodiments, the receptacle is permanently received by the carrier, but flexibility is still provided during the manufacturing and/or assembly stages by permitting a choice of receptacle type to be used with a given carrier.

The carrier 20 may be particularly suited for attachment to certain types of helmets. For example, a wearer may select from any one of a number of different types of helmets to wear, such as Soldier Protection System ("SPS"), Advanced Combat Helmet ("ACH"), or others. The carrier 20 may be particularly suited for attachment to particular sizes of helmets. Accordingly, as each helmet may have a unique shape depending on the type and the size of the helmet, the carrier 20 may be manufactured to have a shape that conforms to the contours of the particular helmet. For example, the carrier may be shaped such that upon attachment of the carrier to the helmet, surfaces of the carrier and the helmet are substantially flush with one another. It should be appreciated that, in some cases, the carrier may be suitably attachable to the helmet, yet may have surfaces that do not substantially conform to the corresponding attachment surface(s) of the helmet.

Figure 2A:
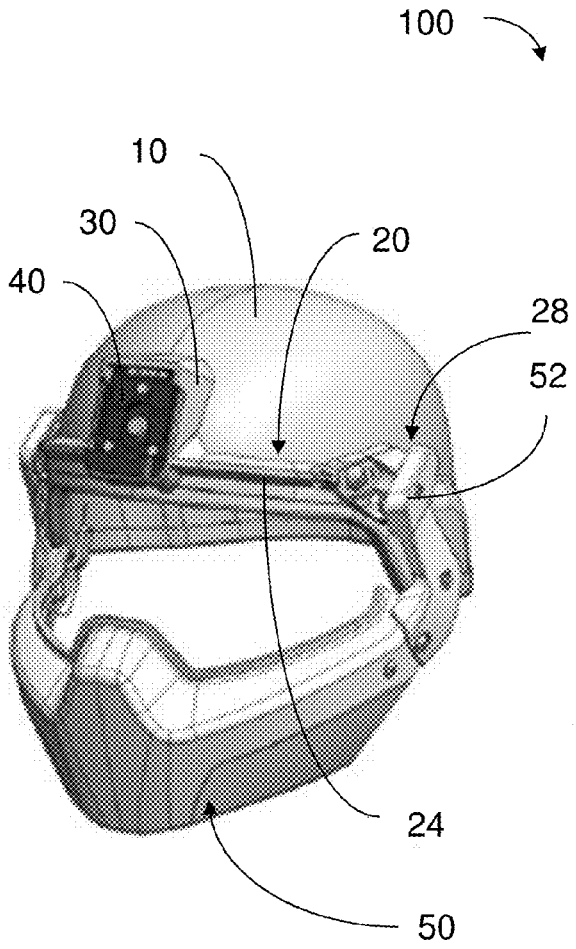
FIG. 2*a* is a perspective of a helmet accessory mount assembly in accordance with some embodiments.
Figure 2B:
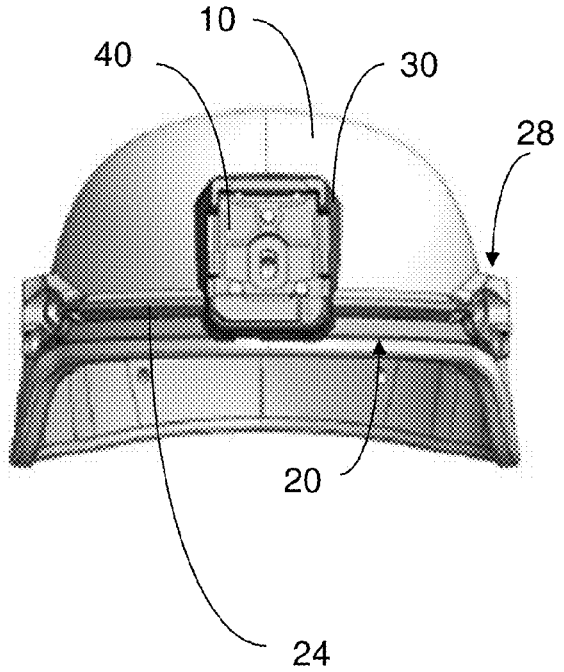
FIG. 2*b* is a front view of a helmet accessory mount assembly in accordance with some embodiments.
Figure 2C:
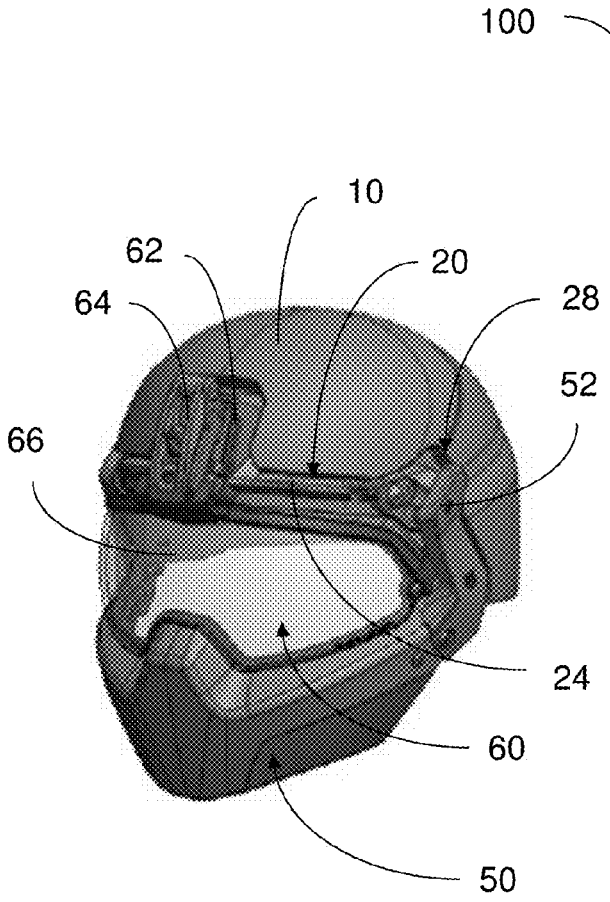
FIG. 2*c* is a perspective of another helmet accessory mount assembly in accordance with some embodiments.
Figure 2D:
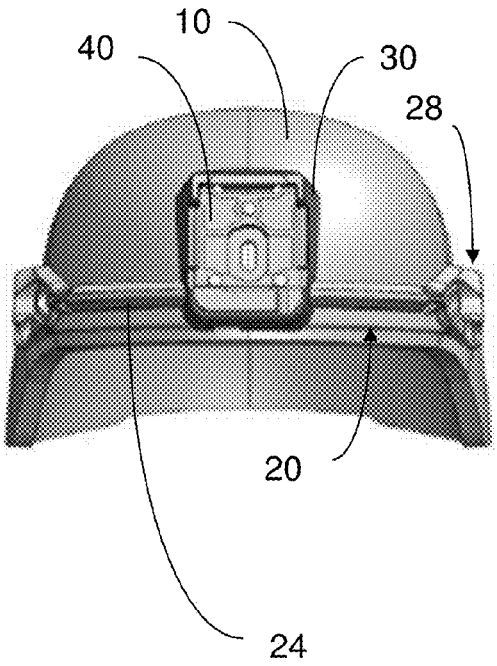
FIG. 2*d* is a front view of another helmet accessory mount assembly in accordance with some embodiments.

FIGS. 2*a* and 2*b* show helmet accessory mount assemblies for different types and sizes of helmets.

FIG. 2*a* depicts a helmet accessory mount assembly for a medium-sized ACH helmet. As shown, the carrier 20 has a surface which conforms to the shape of the corresponding surface of the helmet 10 to which the carrier contacts. In particular, the arms 24 of the carrier may exhibit an arcuate shape that complements the surface of the front portion of the helmet, to which the carrier is attached. The central region of the carrier 20 (covered in FIGS. 2*a*-2*b* by the receptacle 30 and helmet accessory mounting interface 40) is also shaped so as to complement the surface of the helmet. FIG. 2*a* further illustrates a mandible guard 50 for protecting a lower region of the head. In some embodiments, the mandible guard 50 has an optional helmet shell connector 52 which may be attached, by any suitable manner (e.g., snap connection, interference fit, fastener insertion, etc.), to a corresponding optional mandible guard connector 28 of the carrier.

FIG. 2*b* shows a mount assembly for a small-sized SPS helmet. Similar to that described above with respect to the medium-sized ACH helmet, the structure of the carrier complements the unique shape of the corresponding surface of the helmet 10 to which the carrier contacts. FIG. 2*b* depicts the mandible guard 50 with a respective helmet shell connector 52. The optional helmet shell connector 52 of the mandible guard 50 is attached by any suitable attachment method to the helmet 10 at the optional mandible guard connector 28 of the carrier.

Accordingly, each carrier 20 may be manufactured for attachment to a particular type and size of helmet. As an example, given two different types of helmets (e.g., ACH, SPS) and three different sizes of helmets (e.g., small, medium, large), there may be six different types of carriers that are manufactured to accommodate each combination of variables—type of helmet and size of the helmet—as shown in Table 1. It should be appreciated that other types of helmets and sizes of helmets may be used in helmet systems of the present disclosure in any suitable combination, and that the types and sizes listed herein are provided solely by way of example.

TABLE 1

6 different carrier types for manufacture based on type and size of helmet.

| | ACH | SPS |
|---|---|---|
| Small | Small, ACH | Small, SPS |
| Medium | Medium, ACH | Medium, SPS |
| Large | Large, ACH | Large, SPS |

It should be appreciated that carriers may be manufactured to complement any suitable number and combination of each type of helmet and size. For instance, in some cases, an individual carrier may be appropriate for attachment to multiple types and sizes of helmets.

Figure 3A:
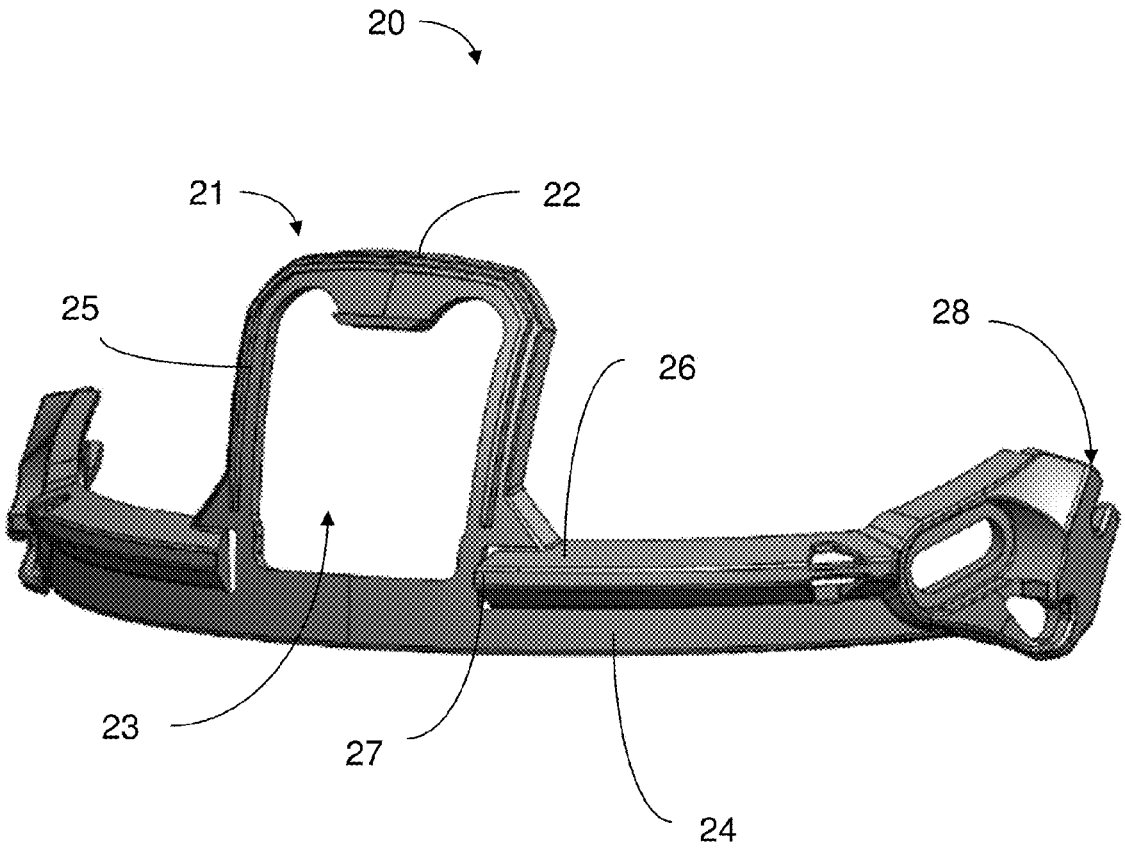
FIG. 3*a* is a perspective view of a carrier in accordance with some embodiments.

FIG. 3*a* illustrates an embodiment of a carrier 20, which includes a receptacle-receiving portion 21 located at a central region of the carrier and at least partially between the arms 24. Each of the arms 24 exhibits an appropriately arcuate shape that extends from the central region of the carrier. In some embodiments, the carrier includes optional mandible guard connectors 28 located at the far end of each arm 24.

The carrier further includes a frame 22 surrounding an opening 23. The frame 22 includes a downwardly disposed tab that may be used to form a fitted coupling with a receptacle 30 and/or a helmet accessory mounting interface 40. The frame 22 also may have features having a particular shape (e.g., beveled edges, ridges, curved ledges, bent features, etc.) that facilitate coupling and decoupling of a receptacle 30 and/or helmet accessory mounting interface 40 to and from the carrier 20.

Figure 8:
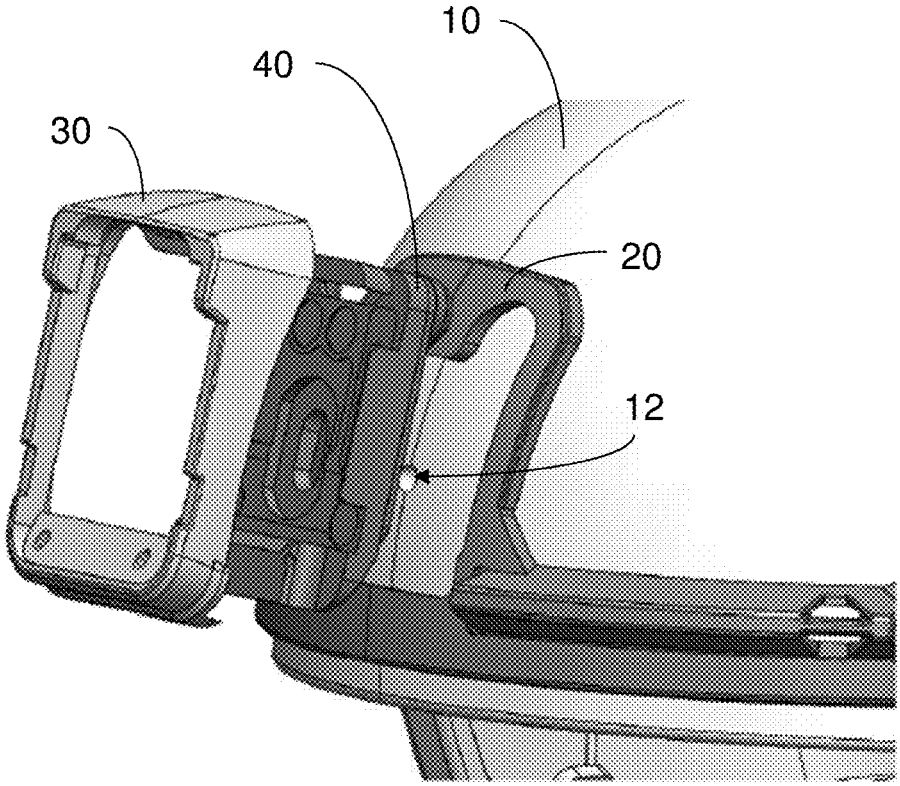
FIG. 8 is a perspective view of a helmet accessory mount assembly in accordance with some embodiments.

In some embodiments, certain features of the frame may function as retaining members to hold a portion of the receptacle and/or helmet accessory mounting interface in place, to establish a coupled arrangement with the carrier. The opening 23 may provide space to accommodate attachment of a receptacle and/or helmet accessory mounting interface to the carrier and/or helmet. For example, a fastener may be used to attach a mounting interface 40 coupled with a receptacle 30 to the front of a helmet 10. As shown, the opening 23 also may provide space for the receptacle 30 and/or helmet accessory mounting interface 40 to be inserted therein. For example, FIG. 8 shows an embodiment where circular portions of a helmet accessory mounting interface 40 are inserted into a complementary arcuate space provided by the opening 23 of the carrier 20.

As further shown in FIG. 3*a*, the carrier 20 may include ridges 26 located opposite one another relative to the central region of the carrier and which extend along the exterior surface of the arms 24. In addition, or alternative to, features of the frame 22, the ridges 26 may be used as retaining members to hold a receptacle and/or helmet accessory mounting interface in position so as to form a coupled arrangement with the carrier. For instance, each of the ridges 26 may include an overhanging portion 27 that extends toward the central region of the carrier. The overhanging portion 27 of each of the ridges 26 may be suitable to form an interference fit with a receptacle 30 in some embodiments. As such, the receptacle 30, having already been coupled together with the helmet accessory mounting interface, may be tilted such that one side of the receptacle may be inserted underneath the overhanging portion of one of the ridges. The other side of the receptacle may be pressed down into the carrier so as to form a snap interference fit with the overhanging portion of the ridge located on the opposite side. Such a fit may allow for a receptacle 30 to be removably, or detachably, coupled to the carrier 20. For example, the receptacle 30 may be slid out from underneath the overhanging portions or pulled out from the grasp of the ridges.

Figure 4A:
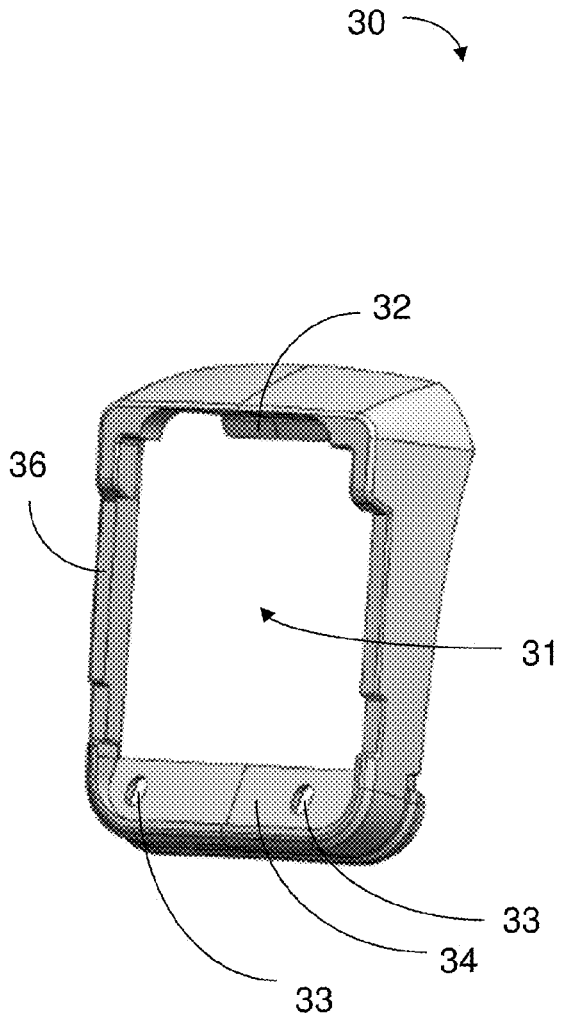
FIGS. 4*a* and 4*b* are front and rear perspective views, respectively, of a receptacle in accordance with some embodiments.
Figure 4B:
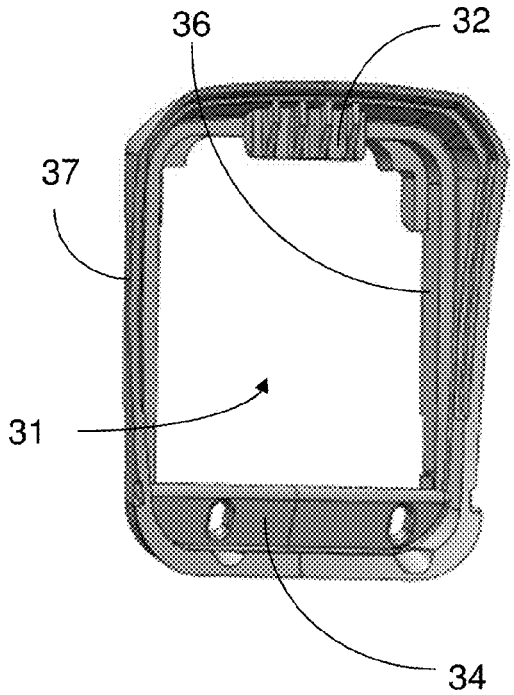
Figure 5A:
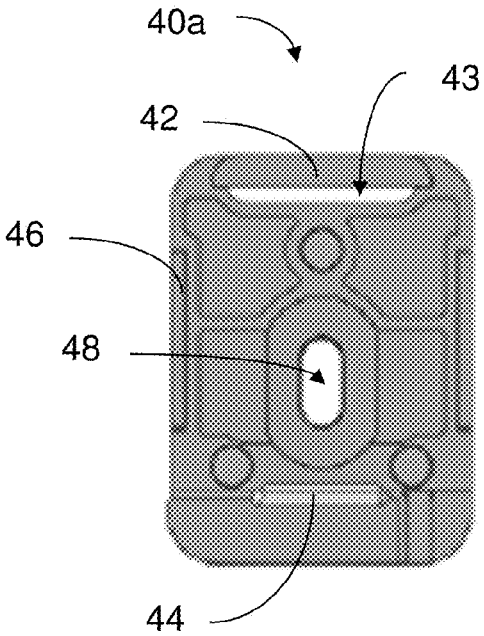
FIGS. 5*a*-5*d* illustrate a number of helmet accessory mounting interfaces in accordance with some embodiments.
Figure 5B:
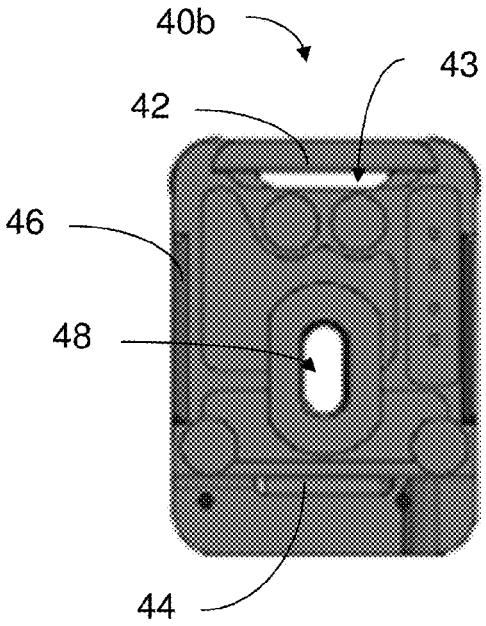
Figure 5C:
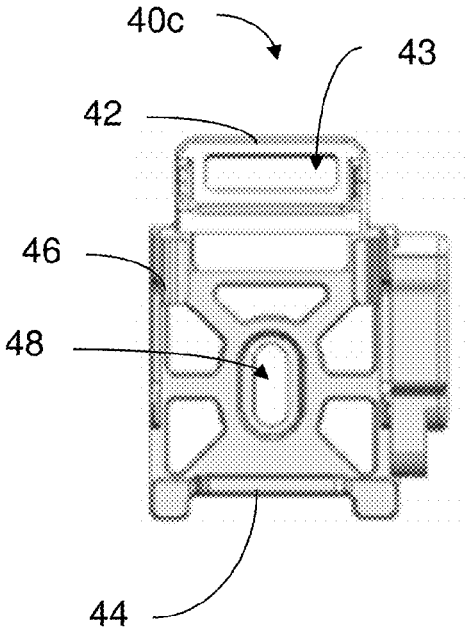
Figure 5D:
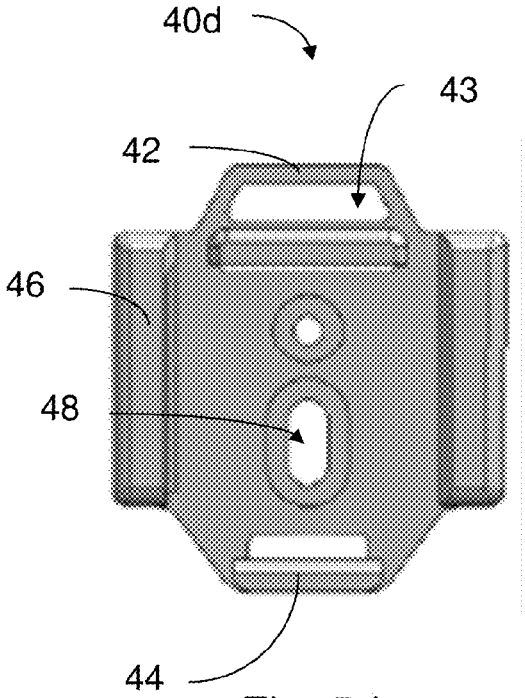

Frame 22 may include various attachment features, including, for example, one or more ribs 25 which fit into associated slots 37 on the back side of the receptacle 30 (see FIG. 4*b*).

It can be appreciated that other arrangements may be possible. For example, overhanging portions may be absent from ridges of the arms. In such an embodiment, when the coupled unit comprising a receptacle and a helmet accessory mounting interface is suitably positioned against the receptacle-receiving portion of the carrier the coupled unit may be held in place while a fastener is installed. Once the fastener is suitably installed, the receptacle and the helmet accessory mounting interface are secured firmly in place. Alternatively, ridges, or other features, optionally may be present so as to provide peripheral support for the coupled unit prior to or during fastening to the carrier/helmet.

In some embodiments, the carrier help suitably position the coupled unit, which includes the mounting interface and the receptacle, on the helmet. Accordingly, the carrier may provide varying degrees of support to the coupled unit. The carrier may fully, partially, or minimally support the coupled unit, or, in some embodiments, the carrier might not provide any direct support to the coupled unit at all. For example, the carrier may provide sufficient support to retain the mounting interface and receptacle on the carrier, yet in some cases, the predominant support of the mounting interface and receptacle on the helmet may be provided by a screw, bolt or other fastener that passes through the mounting interface and into the helmet, thereby holding the interface, coupled with the receptacle, to the helmet.

Figure 3B:
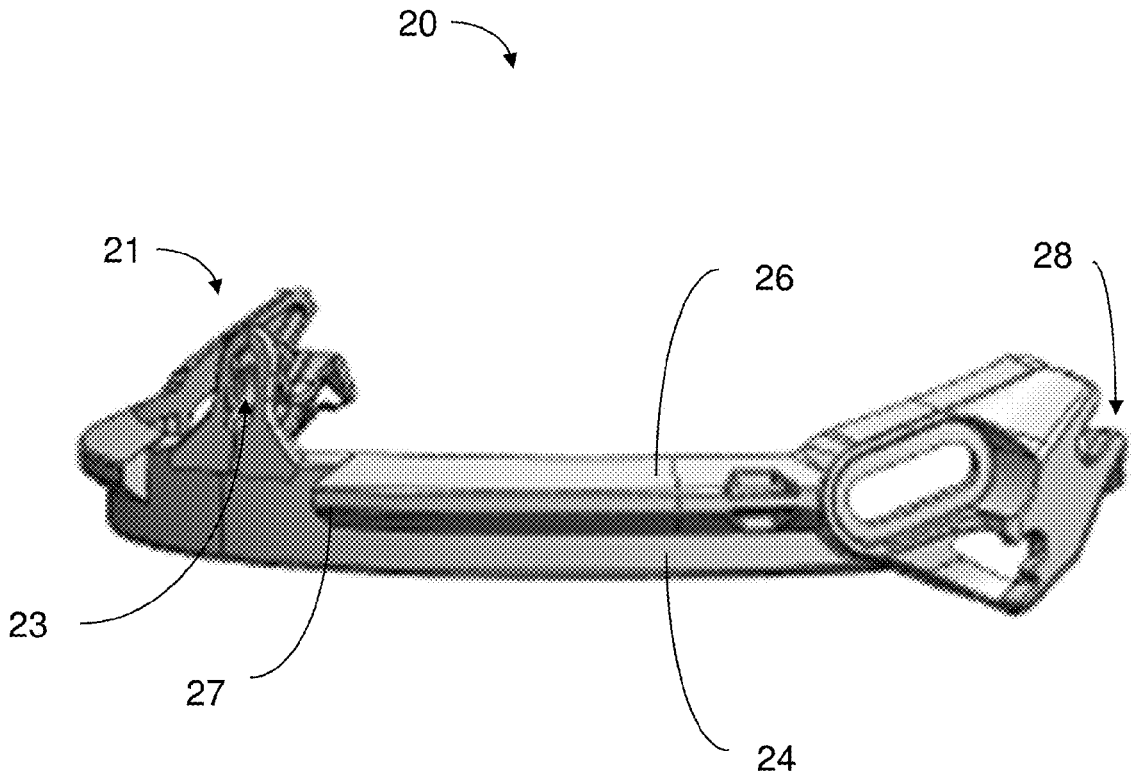
FIG. 3*b* is a perspective view of another carrier in accordance with some embodiments.

FIG. 3*b* illustrates another embodiment of a carrier 20 which is similar to the embodiment of FIG. 3*a* except the larger frame 22 is absent from the receptacle-receiving portion 21. Instead, the receptacle-receiving portion 21 has an opening 23 that may accommodate a fastener for attachment of a receptacle and/or helmet accessory mounting interface to the carrier and/or helmet.

Figure 3C:
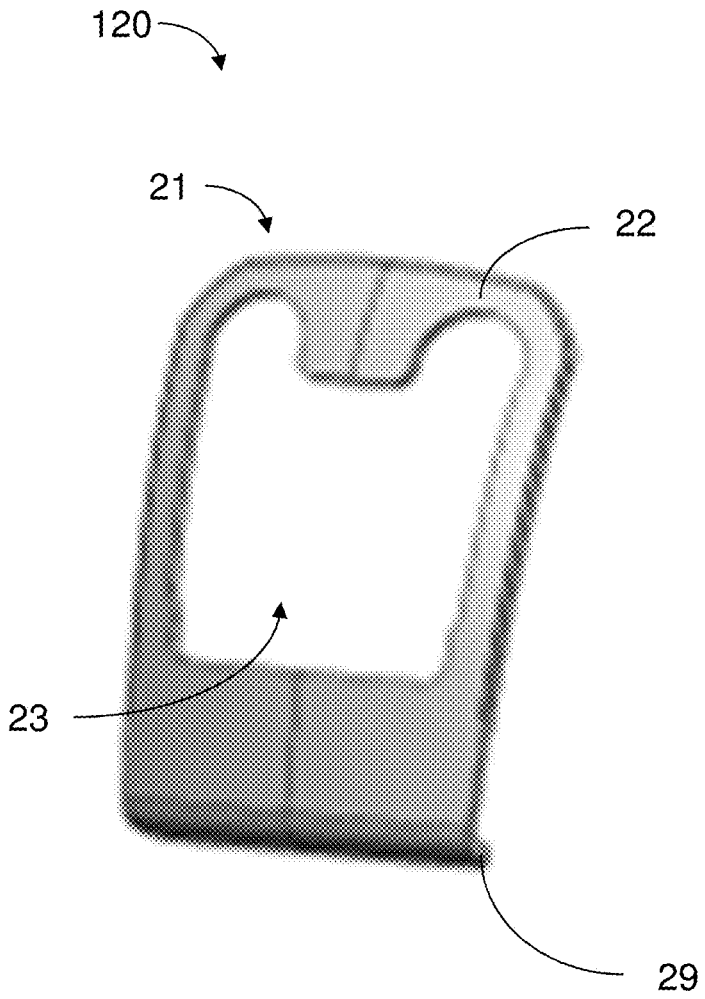
FIG. 3*c* is a perspective view of yet another carrier in accordance with some embodiments.

FIG. 3*c* illustrates yet another embodiment of a carrier 120, which differs from the embodiment of FIG. 3*a* in that the carrier 120 does not include arms, but rather includes a hook 29 at a lower region of the carrier. It should be appreciated that other carriers are possible, such as a carrier that includes arms and a hook, a carrier that include neither arms nor a hook, or a carrier that includes other features. When attached to the helmet, the hook is useful to resist rotation of the carrier. For example, a strong force or moment on the helmet assembly mounting interface may have a tendency to undesirably rotate and/or twist the mount assembly. The interaction of hook 29 with the rim of the helmet may help resist such rotation and/or twisting.

FIGS. 4*a*-4*b* depicts an embodiment of a receptacle 30 configured to receive and form a detachable coupling with a helmet accessory mounting interface 40 (see, e.g., FIGS. 5*a*-5*d*) which, in turn, provides a surface via which a particular accessory may be mounted to the helmet. The receptacle may be used as an adaptor for the helmet accessory mounting interface, facilitating suitable attachment/coupling to occur between the helmet accessory mounting interface and the carrier/helmet. Accordingly, the carrier may be able to universally receive any one of a number of receptacle types, on which a particular accessory may be docked or otherwise mounted.

As shown, the receptacle 30 includes an opening 31 which may accommodate the positioning of a fastener for attaching the receptacle and/or helmet accessory mounting interface to the carrier and/or helmet. For example, the receptacle 30 may receive a helmet accessory mounting interface 40, which may have an attachment hole for a fastener to be inserted. Thus, the fastener may be used to attach the coupled unit, which includes the receptacle and the helmet accessory mounting interface, to the helmet and/or carrier.

As discussed above, the receptacle 30 may be suitably structured to receive one or more types of helmet accessory mounting interfaces 40. To facilitate coupling of a helmet accessory mounting interface to the receptacle 30, the receptacle may include various features, such as those shown in FIGS. 4*a*-4*b*. For instance, the receptacle may include an upper tab 32, fastener holes 33 a ledge 34 at a lower region of the receptacle, and side tabs 36.

The receptacle 30 also may be suitably structured to engage or otherwise be positioned with multiple different types of carriers. For example, a carrier 20 with arms 24 (e.g., carrier of FIG. 3*a*) may be replaced with a carrier 20 without arms, yet having a hook 29 (e.g., carrier of FIG. 3*c*). It should be appreciated that the same receptacle 30 may be employed with either carrier, or other suitable carriers.

A helmet accessory mounting interface may be suitably structured for a particular accessory, or multiple accessories, to be attached to the helmet accessory mounting interface; and also may be suitably structured for attachment to a complementary receptacle. Accordingly, the helmet accessory mounting interface may have features that allow for a connection to occur with a receptacle structured in a suitable fashion. It should be appreciated that the helmet accessory mounting interface may have any suitable shape and size and may engage with a receptacle as well as facilitate mounting of an accessory to a helmet, in any suitable manner. Helmet accessory mounting interfaces described herein may be suitable to accommodate the mounting of multiple accessories one at a time or simultaneously. For example, multiple accessories may be mounted on to a helmet for use at the same time.

FIGS. 5*a*-5*d* illustrate a number of embodiments of helmet accessory mounting interfaces 40 on which a specific type of helmet accessory may dock. While not so limited, each of the helmet accessory mounting interfaces are shown as accessory plates which include features that are suitably structured for mounting of an accessory to the mounting interface, as well as coupling the interface with a suitable receptacle. The helmet accessory mounting interfaces shown in FIGS. 5*a*-5*d* correspond to various types and brands of accessories that may be used when the helmet is worn.

Various features of each of the helmet accessory mounting interfaces 40*a*, 40*b*, 40*c*, 40*d*, amongst others, include an upper retainer 42, a slot 43 a lower retainer 44, side retainers 46 and an attachment hole 48. Such features may allow the helmet accessory mounting interface to be easily attachable to as well as removable from a receptacle.

As an example of an attachment between a receptacle 30 and a helmet accessory mounting interface 40, the two components may be tilted relative to one another such that an upper tab 32 of a receptacle 30 slides into a slot 43 of the mounting interface 40. When the helmet accessory mounting interface is allowed to rest on the receptacle, after the previous step of tilted insertion into the slot 43, the upper tab 32 of the receptacle becomes coupled with the upper retainer 42 of the helmet accessory mounting interface. Certain features of the helmet accessory mounting interface, such as the lower retainer 44, may subsequently be pressed toward complementary features of the receptacle, such as the ledge 34, so as to form a suitable snap interference fit between the receptacle and the helmet accessory mounting interface. Other features of the helmet accessory mounting interface and the receptacle also may engage in a complementary fashion, for example, the side tab 36 of the receptacle and the side retainer 46 of the helmet accessory mounting interface. It should be appreciated that other arrangements for coupling the receptacle and helmet accessory mounting interface together may be used.

Figure 9A:
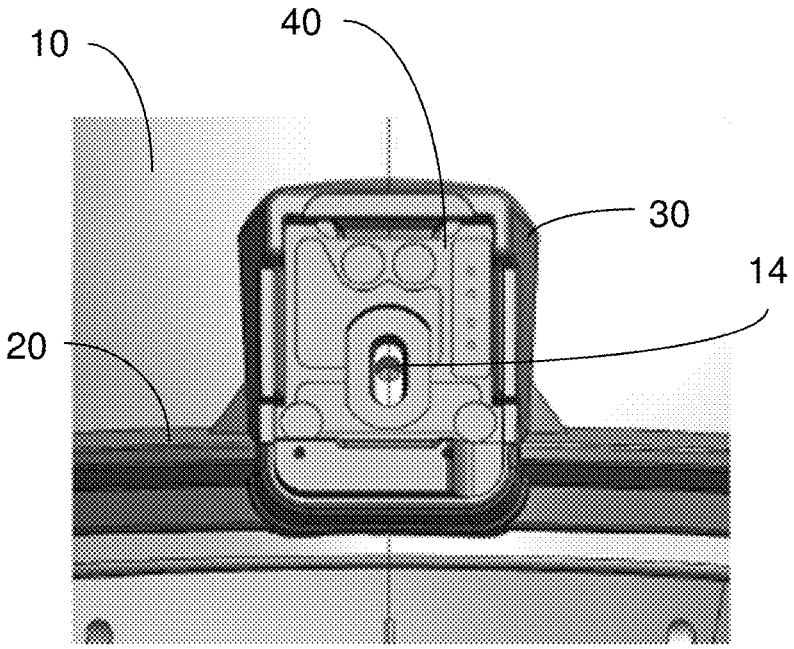
FIGS. 9*a*-9*b* are front and perspective views of a helmet accessory mount assembly in accordance with some embodiments.
Figure 9B:
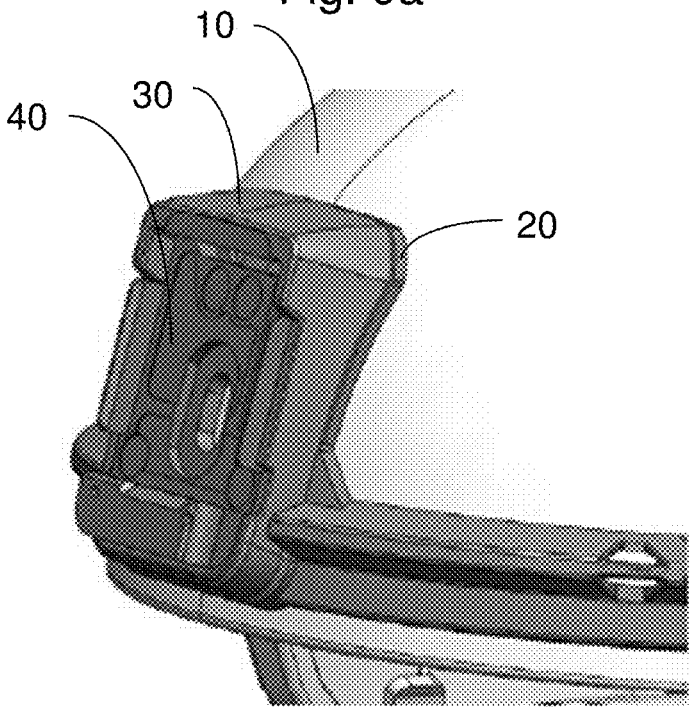

The attachment hole 48 may be provided to accommodate placement of a fastener (e.g., threaded screw, nut and bolt, etc.) within the hole so that the helmet accessory mounting interface may be attached to the helmet. In some embodiments, as discussed above, upon appropriate attachment, the helmet accessory mounting interface and the receptacle form a coupled unit. The coupled unit then may be held against the receptacle-receiving portion of the carrier in a manner such that a fastener may be inserted through the attachment hole 48 and respective openings 23, 31 of the carrier 20 and the receptacle 30. Once the fastener is sufficiently installed, e.g., screwed into the helmet, as shown in FIGS. 9*a*-9*b*, then the assembly is ready to receive a suitable helmet accessory.

Each helmet accessory mounting interface may be specially suited to form a connection with one or more accessories for the helmet. For instance, FIGS. 6*a* and 6*b* depict embodiments of helmet accessories 60, 70 that may be docked to a helmet at an appropriately situated helmet accessory mounting interface.

Figure 6A:
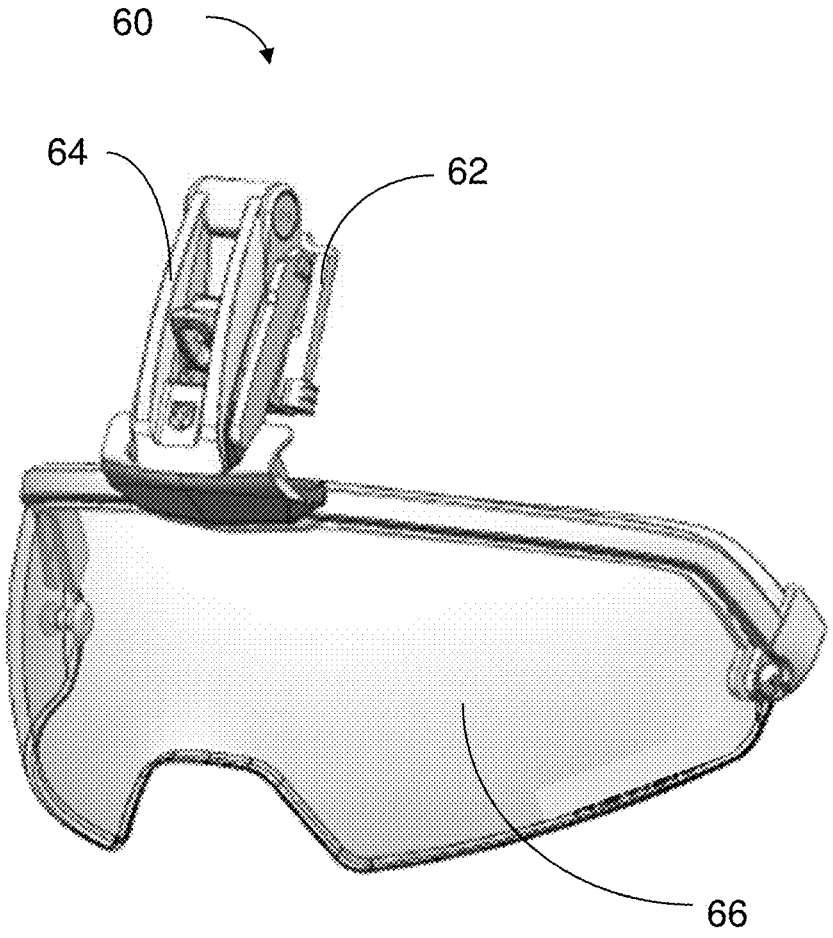
FIG. 6*a* is a perspective view of a helmet accessory in accordance with some embodiments.

In FIG. 6*a*, the accessory 60 provides the wearer with a protective visor 66. The accessory includes a helmet accessory mounting interface connector 62 (e.g., accessory base plate), which has suitable features that allow the accessory to be docked firmly to the helmet through the mount assembly, which may include a helmet accessory mounting interface, receptacle and carrier.

A bridge 64 joins the helmet accessory mounting interface connector 62 with a visor 66. The bridge 64 may be actuated in any suitable manner. For instance, the bridge may provide the ability for the visor to be lowered into a deployed position, so as to fill, and optionally seal, a suitable opening provided between the outer shell of the helmet and the mandible guard. Once in place, the visor 66 may provide protection from projectiles, radiation, or other potentially harmful elements. When the visor is not needed, the bridge 64 may be actuated so as to raise the visor from its deployed position, exposing the space between the outer shell of the helmet and the mandible guard.

Figure 6B:
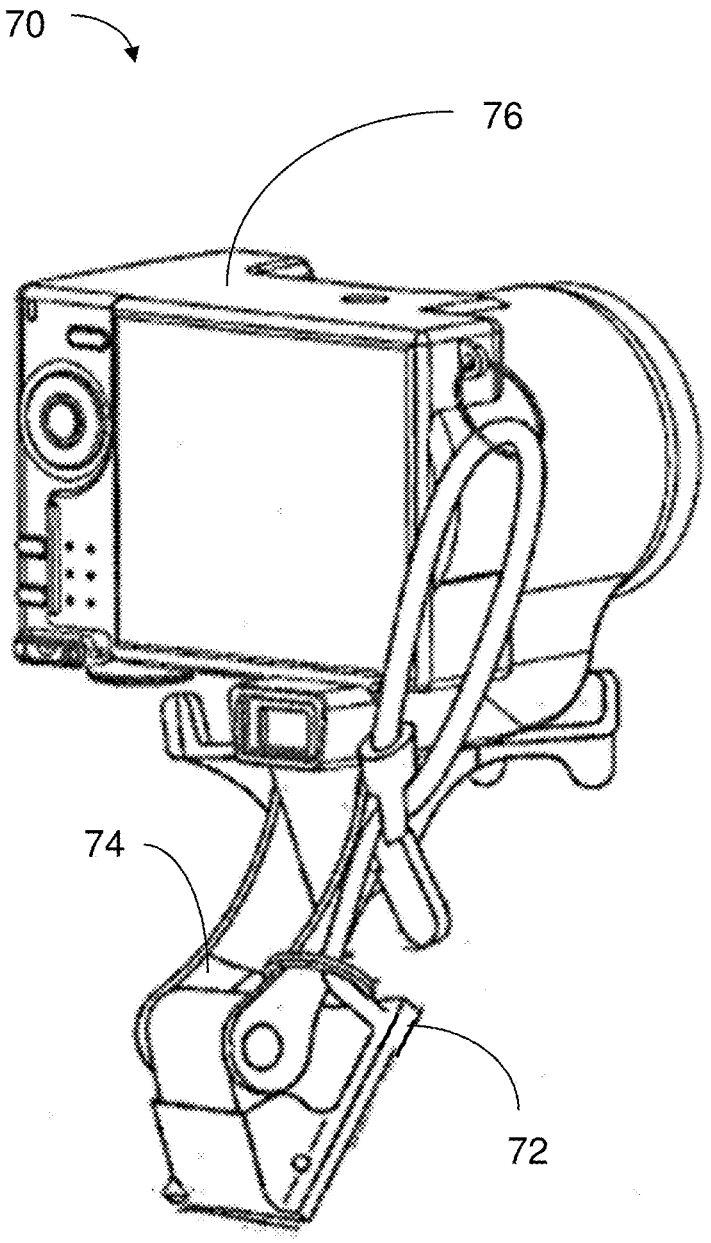
FIG. 6*b* is a perspective view of another helmet accessory in accordance with some embodiments.

In FIG. 6*b*, the accessory 70 provides the wearer with a camera 76. The accessory includes a helmet accessory mounting interface connector 72, which has suitable features that allow the accessory to be docked to the helmet through the mount assembly. A bridge 74 joins the helmet accessory mounting interface connector 72 with a camera 76. Similar to the accessory 60 described above, the bridge 74 may be actuated in any suitable manner, and may provide the ability for the camera to be moved between a number of different positions. For example, the camera may be raised, lowered, rotated, or otherwise adjusted, as desired. Once the camera is set in place, the bridge 74 may be placed in a fixed position so that relatively steady pictures/video may be recorded.

A receptacle coupled with a mounting interface can be arranged in any one of numerous configurations, to mount an accessory to a helmet. In some embodiments, a coupled receptacle and mounting interface may be configured such that a single motion with an accessory, such as a sliding motion, engages a mounting interface connector of an accessory with the accessory mounting interface. An accessory may snap into an engaged state by passing over a flexible tab or other component. In other embodiments, other mounting components may be used such as clasping devices or fasteners.

It should be appreciated that other accessories with various functionalities may be used. For example, a head lamp or a communication device may be provided as a helmet accessory.

In some embodiments, accessories such as a head lamp, night vision goggles, or a communication device may receive power from the mounting assembly, for example, via electrical contacts on the accessory mounting interface (e.g., mounting plate). Such accessories may receive power via the mounting assembly, and may require a particular mounting interface configuration, which may or may not be compatible with other accessories. Such a configuration may include a battery pack at the rear of the helmet and power cabling which runs along the helmet surface to a mounting interface at the front of the helmet. Electrical contacts may be included on the mounting interface such that when a device is attached to the mounting interface, the device can draw power from the battery pack via the electrical contacts of the mounting interface.

As discussed above, a number of different types of carriers may be manufactured to suit the type and the size of each helmet to which the carrier is attached. As also discussed, each helmet accessory mounting interface may be manufactured to suit the type and/or brand of accessory to be mounted on to the helmet. Receptacles also may be manufactured according to the particular helmet accessory mounting interface to be received.

In some instances, carriers and receptacles are manufactured to be integral with one another where the receptacle is structured to receive a single type of helmet accessory mounting interface. In such cases, the carrier and receptacle combination is provided based on three different variables; that is, for attachment to a particular type of helmet, size of helmet, and the accessory to be used on the helmet.

As an example, given two different types of helmets (e.g., ACH, SPS), three different sizes of helmets (small, medium, large) and three different types of accessories to be mounted on to the helmet (e.g., visor, goggles, camera), there are eighteen different types of carriers that are to be made for each combination of variables, as shown in Table 2. Thus, it can be burdensome to manufacture individual helmet accessory mount carriers that each specifically account for all three variables. Of course, it can be appreciated that other types of helmets, sizes of helmets, and accessories may be used in helmet systems of the present disclosure, and in any suitable combination.

TABLE 2

Eighteen different carrier types for manufacture based on type, size of helmet, and accessory to be mounted.

| | ACH | SPS |
|---|---|---|
| | Visor | |
| Small | Small, ACH, Visor | Small, SPS, Visor |
| Medium | Medium, ACH, Visor | Medium, SPS, Visor |
| Large | Large, ACH, Visor | Large, SPS, Visor |
| | Goggles | |
| Small | Small, ACH, Goggles | Small, SPS, Goggle |
| Medium | Medium, ACH, Goggles | Medium, SPS, Goggles |
| Large | Large, ACH, Goggles | Large, SPS, Goggles |
| | Camera | |
| Small | Small, ACH, Camera | Small, SPS, Camera |
| Medium | Medium, ACH, Camera | Medium, SPS, Camera |
| Large | Large, ACH, Camera | Large, SPS, Camera |

In accordance with aspects of the present disclosure, the receptacle may be separate from the carrier. The carrier may have modular characteristics, including a receptacle-receiving portion that is able to receive any suitable receptacle or coupled unit, comprising a combination of a receptacle and a helmet accessory mounting interface, that is structured independently from the type of the helmet or size of the helmet. That is, any receptacle and helmet accessory mounting interface combination and, hence, any helmet accessory, may be selected for mounting by a wearer without regard for the type or size of helmet that is used.

Accordingly, aspects of the present disclosure make it unnecessary to manufacture carriers that are uniquely suited for attachment to a particular type and size of helmet and also uniquely suited for mounting of a particular helmet accessory thereon. Rather, in accordance with embodiments herein, a wearer may choose a carrier that is suitable for attachment to a certain type and size of helmet, and decide at a later time which accessory to use. Because the carrier may be suitable to receive any suitable receptacle which may be coupled with a helmet accessory mounting interface, the wearer may select whatever helmet accessory he/she desires to be mounted on to the helmet, without having to replace the carrier.

When it is desired for a different accessory to be mounted to the helmet, the wearer or user may easily remove the receptacle and helmet accessory mounting interface from the carrier (e.g., by unscrewing a fastener) and install a receptacle and helmet accessory mounting interface combination that accommodates mounting of the preferred accessory. For example, a user may unscrew a fastener from the mounting assembly and may pick the receptacle up from the carrier. If the receptacle is held in place on the carrier, for example, by one or more retaining members, then the user may appropriately separate the receptacle away from the retaining members, and then install a replacement receptacle.

As a result, the burden of manufacturing helmet accessory mount carriers that are each specific to helmet type, helmet size and accessory to be used is alleviated. In some cases, an assembler (e.g., machine, assembly worker) may attach a carrier to a certain type and size of helmet and subsequently position a receptacle, which may be coupled with a helmet accessory mounting interface, at an appropriate location on the carrier, i.e., at a receptacle-receiving portion. The receptacle, together with the helmet accessory mounting interface, may be attached or otherwise coupled to the carrier/helmet so as to allow for an appropriate accessory to be mounted to the helmet. When appropriate, an assembler may remove the receptacle from the receptacle-receiving portion of the carrier, for example, by detaching, unfastening, or simply pulling the receptacle up from the carrier; and then suitably replacing the receptacle. In some embodiments, the receptacle is permanently attached to the carrier and/or helmet.

In the above example provided by Table 2, the wearer does not have to choose between eighteen different carrier types that correspond to the type of helmet, size of the helmet, and accessory to be mounted to the helmet. Instead, the wearer would only need to choose between 6 different carrier types, as provided by Table 1, and the particular helmet accessory, or helmet accessories, to be used may be selected at a later time. When the helmet accessory to be used is chosen (e.g., one of a visor, scope, camera, etc.), the appropriate combination of receptacle and helmet accessory mounting interface is attached to the helmet/carrier, for subsequent mounting of the accessory.

Alternatively, a carrier and receptacle may be manufactured to be integral with one another where the receptacle is structured to receive multiple different types of helmet accessory mounting interfaces, which each may be suitable to accommodate mounting of one or more helmet accessories. As a result, a wearer may still choose a carrier/receptacle combination that is appropriate for attachment to a certain type and size of helmet, and decide at a later time which accessory to use. The receptacle may be suitable to receive one or more appropriate helmet accessory mounting interfaces, and so the wearer may select a helmet accessory for use with the helmet without having to replace the combined carrier and receptacle.

As discussed above, a receptacle may be mounted to multiple different types of carriers, for example, carriers structured for certain types and sizes of helmets, as well as carriers having arms and/or hooks. For instance, a user fitted with a helmet having a carrier, receptacle and helmet accessory mounting interface may prefer that a carrier having arms be removed from the helmet and be replaced with a carrier having no arms, yet includes a hook; although, the user also may prefer to employ the same receptacle and mounting interface combination. Accordingly, the user may remove the carrier having arms from the helmet and attach the carrier with a hook to the helmet. Then, the user may install the same receptacle and mounting interface combination to the new carrier, for subsequent mounting of the preferred helmet accessory.

Figure 7A:
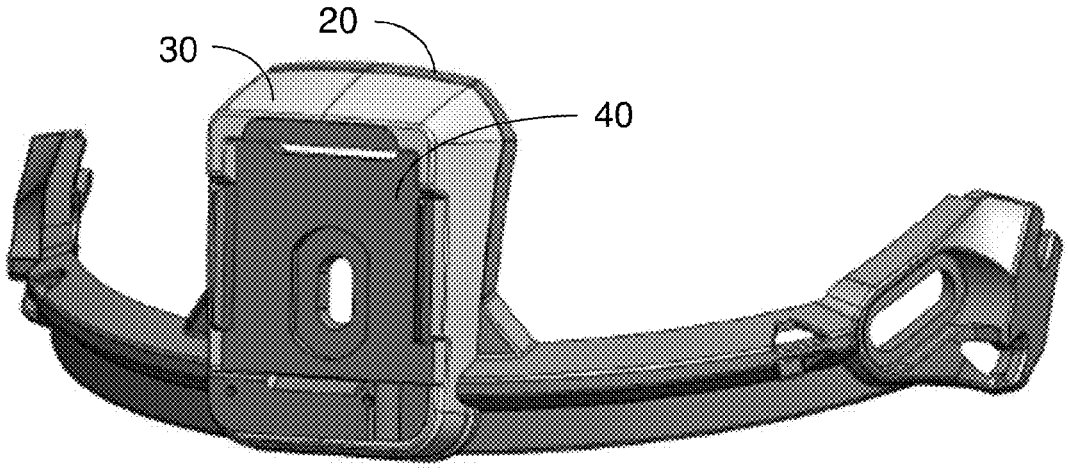
FIGS. 7*a* and 7*b* are front and rear perspective views, respectively of a helmet accessory mount assembly in accordance with some embodiments.
Figure 7B:
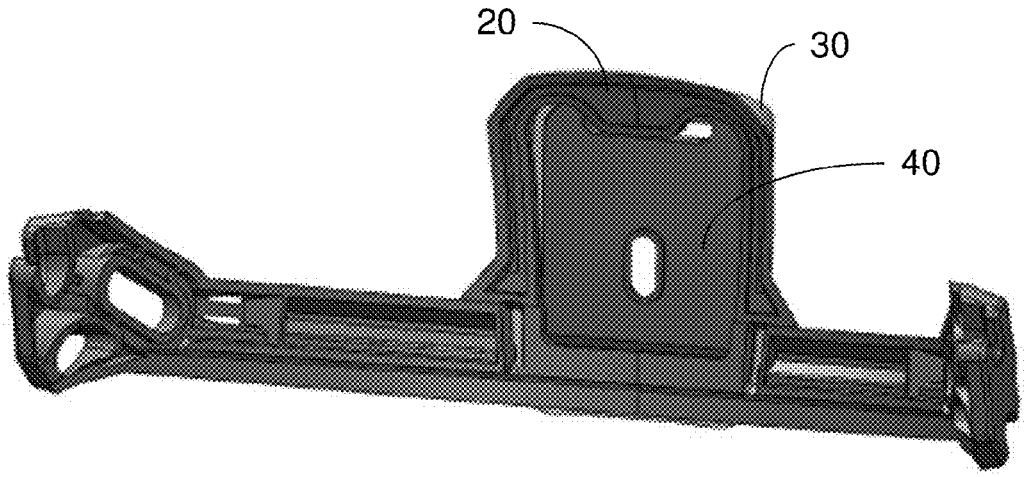

FIGS. 7*a*-7*b* show a helmet accessory mount assembly where a helmet accessory mounting interface 40 (e.g., metal mounting plate) is attached to the receptacle 30. The coupled unit, which includes the combined receptacle and mounting interface, is then further coupled, detachably so, to the receptacle-receiving portion of the carrier 20.

FIG. 8 illustrates an embodiment of a method of installation where the helmet accessory mounting interface 40 is located in between the receptacle 30 and the carrier 20. In some embodiments, the helmet accessory mounting interface 40 is coupled to the receptacle 30 and subsequently, the coupled unit including the helmet accessory mounting interface 40 and the receptacle 30 is positioned at the receptacle-receiving portion of the carrier.

For example, as also discussed above, a helmet accessory mounting interface (e.g., mounting plate) may be tilted so that a tab of the receptacle is inserted into a slot of the mounting interface. The mounting interface and the receptacle then may be pressed together so as to form a snap interference fit between other complementary features of the mounting interface and receptacle. The coupled unit then may be brought toward the carrier. In some embodiments, the coupled unit is tilted relative to the carrier such that a side of the receptacle slides underneath the overhanging portion of the ridges. The coupled unit is then pressed into the carrier and helmet so as to suitably snap in place with the oppositely located overhang. In some embodiments, a fastener is also used to attach the coupled unit to the carrier/helmet through respective openings, i.e., attachment hole 12 of the helmet 10, opening 23 of the carrier 20, opening 31 of the receptacle 30, and attachment hole 48 of the helmet accessory mounting interface 40.

While not shown in the figures, it may be desirable for the helmet not to have an attachment hole. For example, inclusion of one or more holes (e.g., through holes, threaded holes, etc.) in the helmet may reduce the integrity of the helmet shell. Accordingly, in some embodiments, a plastic or metal block may be attached to the surface of the helmet. The block may include an attachment hole through which a fastener may be inserted and/or screwed. Thus, the helmet accessory mounting interface and receptacle may be attached to the helmet via a fastener without requiring the helmet to have a hole. Such a block may be attached to the surface of the helmet in any suitable manner, such as by application of an adhesive, hook and loop fasteners, a sliding connection, locking features, etc.

It can be appreciated that various components may be attached in other configurations and in various sequences, in any suitable manner. For example, the helmet accessory mounting interface may be attached to the receptacle at the front or the rear of the receptacle. Or, one of the receptacle or the helmet accessory mounting interface may be attached to the receptacle-receiving portion of the carrier prior to attachment to each other.

It should be appreciated that the carrier may be coupled to and fully support a coupled unit, which includes the receptacle and helmet accessory mounting interface, without the use of fasteners. For example, the receptacle and/or helmet accessory mounting interface may be coupled to the carrier via an interference or friction fit, or through sliding engagement with the carrier, or other methods of attachment. Of course, other configurations for the carrier are possible, as this aspect is not limited in this regard. In some cases, a receptacle and/or helmet accessory mounting interface may be coupled to the carrier without the carrier fully supporting the receptacle or helmet accessory mounting interface. For instance, the carrier may only partially support the receptacle or helmet accessory mounting interface, where another component or fastener may provide most, or all, of the support.

As shown in FIGS. 9*a*-9*b*, once the helmet accessory mounting interface and receptacle are suitably situated/attached to the helmet and carrier, an appropriate accessory may be docked to the helmet accessory mounting interface. When the carrier 20 is attached to helmet 10, the carrier 20 may provide substantial support to the coupled receptacle 30 and mounting interface 40 while on the helmet. In some cases, the mounting interface 40 may be secured to the helmet by a fastener 14 that is threaded through an attachment hole 48 of the mounting interface 40 and into an attachment hole 12, or through other portions of the helmet 10.

Figure 10A:
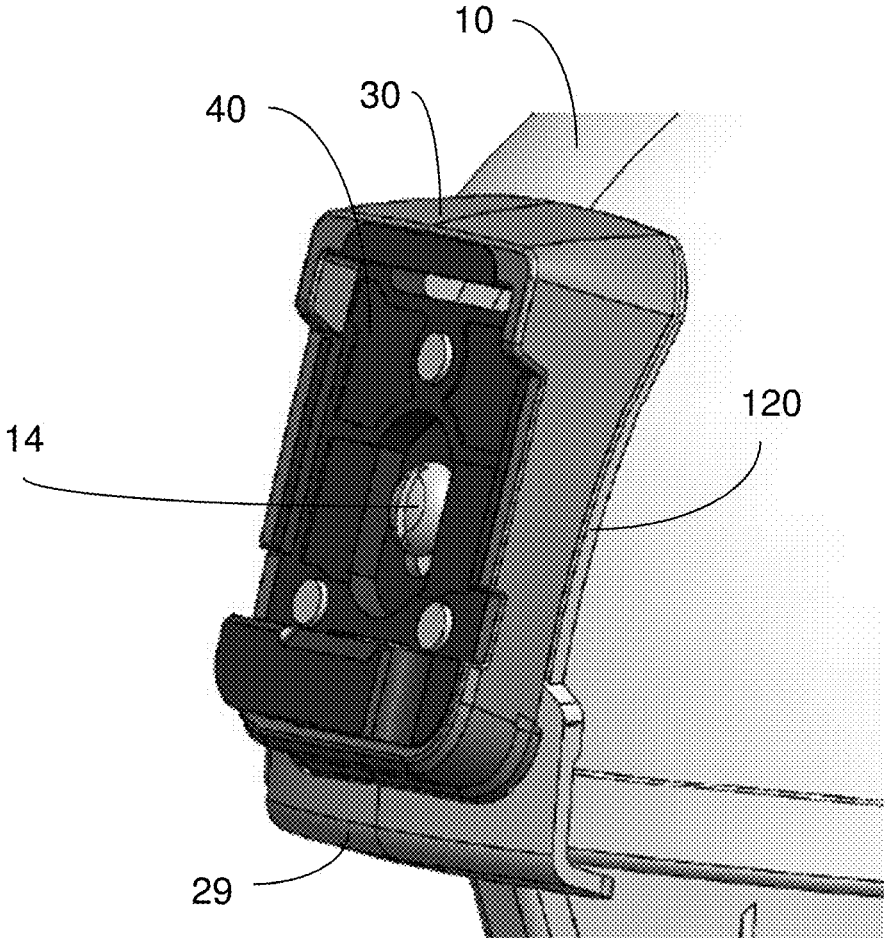
FIG. 10*a* is a perspective view of a helmet accessory mount assembly in accordance with some embodiments.
Figure 10B:
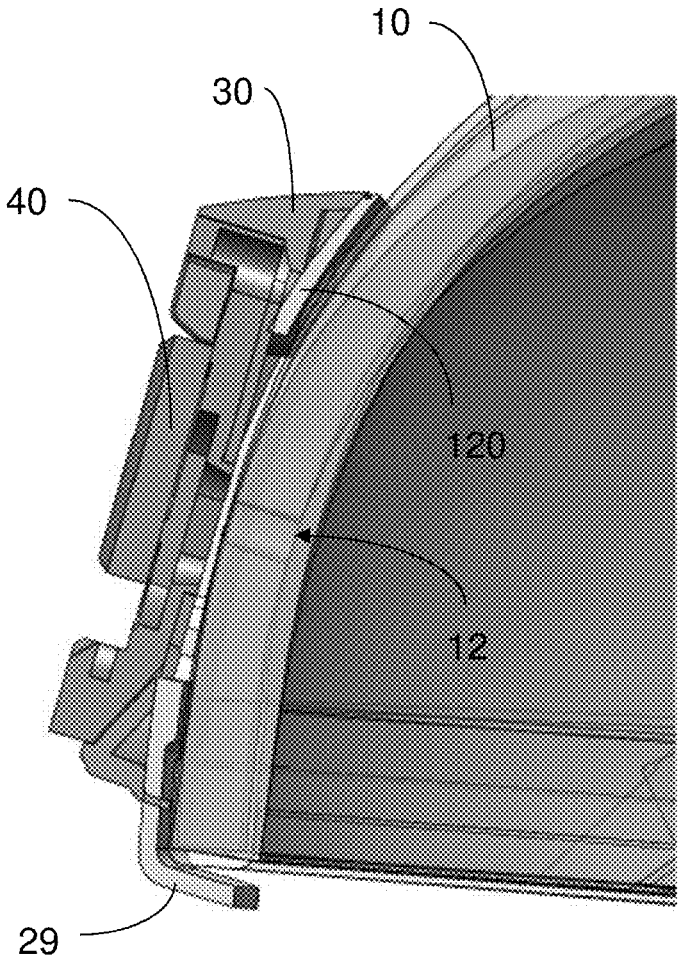
FIG. 10*b* is a cross-section of the helmet accessory mount assembly of FIG. 10*a*.

FIGS. 10*a*-10*b* show another embodiment of a mounting assembly for a helmet accessory. Here, the carrier shown in FIG. 3*c* is employed. As shown, the carrier 120 is attached to the helmet 10, by any suitable manner, and the coupled unit that includes the helmet accessory mounting interface 40 and receptacle 30 is screwed into the helmet by a fastener 14.

A helmet accessory, when mounted, may have a weight such that a substantial moment is created about the point of attachment of the mounting assembly. As a result of this moment, there may be tendency for the carrier, along with the receptacle and mounting interface, to rotate forward from the helmet. The carrier may include a hook 29 having a surface that resists rotation of an upper region of the carrier away from the helmet, preventing the carrier or other components from tilting forward.

Such a hook 29 may be useful for this embodiment, and also may be combined with other embodiments. For example, a carrier 120 may include a hook 29 along with arms 24 on either side a central region of the carrier, both of which may be useful to provide added stability for the accessory mount system. It should also be appreciated that other such components that provide resistance to undesirable movement of components of the helmet accessory mounting assembly also may be employed.

The above described components may be made of various materials, as the invention is not necessarily limited to particular compositions. For example, the helmet, carrier, receptacle and/or helmet accessory mounting interface may be made of various polymers, composites, metals and combinations of any of the foregoing. For instance, the helmet accessory mounting interface may be made of metal, or another suitable material. In some embodiments, the carrier and/or receptacle may be made from a nylon such as the super tough nylon known as Zytel®, which may be obtained from DuPont. In one embodiment, the helmet, carrier, receptacle and/or helmet accessory mounting interface may be made from a synthetic fiber such as Kevlar®, which may be obtained from DuPont. In one embodiment, the helmet, carrier, receptacle and/or helmet accessory mounting interface may be made from carbon fibers. The helmet, carrier, receptacle and/or helmet accessory mounting interface may be made from materials designed to withstand various ballistic, compression and deformation testing, such that the helmet and an optional battery included with the helmet are suitable for various military applications. In one embodiment, the carrier, receptacle and/or helmet accessory mounting interface may be made of a nylon material. The mounting hardware between the carrier, helmet, receptacle and helmet accessory mounting interface may be constructed of any suitable material such as a metal, polymer, composite, or combination of any of the foregoing.

According to one aspect, the mounting hardware may be formed using any suitable process. The hardware may be stamped out of sheet metal, cast, injection molded, extruded, and so on. In addition, the carrier, receptacle and/or helmet accessory mounting interface may be formed using any suitable process, such as injection molding, extrusion, casting, blow-molded, and so on. Any suitable finishing and/or processes may be applied to the hardware, carrier, receptacle and/or helmet accessory mounting interface.

The above aspects may be employed in any suitable combination, as the present invention is not limited in this respect. Additionally, any or all of the above aspects may be employed in a helmet accessory mounting system; however, the present invention is not limited in this respect, as the above aspects may be employed with other mounting applications.

According to some embodiments, accessories are attached to a helmet using any of the mounting systems disclosed herein. Such arrangements and methodologies of use are not limited solely to helmet applications. According to some aspects, the mounting system may be used to mount accessories to body armor and other articles.

Having thus described several aspects of at least one embodiment of this invention, it is to be appreciated that various alterations, modifications, and improvements will readily occur to those skilled in the art. For example, the helmet accessory mounting system described herein may be adapted for use in other applications such as mounting to body armor or a backpack. Such alterations, modifications, and improvements are intended to be part of this disclosure, and are intended to be within the spirit and scope of the invention. Accordingly, the foregoing description and drawings are by way of example only.

What is claimed is:

1. An apparatus comprising:

a helmet accessory mounting interface;

a receptacle that is configured to hold the helmet accessory mounting interface without a helmet accessory attached to the helmet accessory mounting interface; and a carrier attachable to a helmet, the carrier including:

a first arm and a second arm located opposite one another relative to a central region of the carrier, each arm extending in a respective direction away from the central region of the carrier; and the carrier including a receptacle-receiving portion to removably receive the receptacle;

wherein the helmet accessory mounting interface, the receptacle, and the carrier are configured such that when the helmet accessory mounting interface, the receptacle, and the carrier are attached to the helmet, the helmet accessory mounting interface is ready to receive a helmet accessory, and the helmet accessory mounting interface is located between the carrier and the receptacle.

2. The apparatus of claim 1, wherein the receptacle-receiving portion has at least one retaining member.

3. The apparatus of claim 2, wherein the at least one retaining member comprises a first ridge and a second ridge located opposite one another relative to the central region of the carrier.

4. The apparatus of claim 3, wherein each of the first and second ridges includes an overhanging portion extending toward the central region of the carrier.

5. The apparatus of claim 4, wherein the overhanging portion of each of the first and second ridges is configured to form an interference fit with the receptacle.

6. A helmet accessory mount assembly, comprising:

a carrier constructed and arranged to be attached to a helmet, the carrier including a receptacle-receiving portion;

a receptacle removably received by the receptacle-receiving portion of the carrier, wherein when the carrier is attached to the helmet and the receptacle is attached to the carrier, the receptacle is removable from the carrier without removing the carrier from the helmet; and a helmet accessory mounting interface attached to the receptacle without a helmet accessory attached to the helmet accessory mounting interface; wherein the helmet accessory mounting interface is located between the carrier and the receptacle.

7. The assembly of claim 6, wherein the carrier comprises a first arm and a second arm located opposite one another relative to a central region of the carrier, each arm extending in a respective direction away from the central region of the carrier.

8. The assembly of claim 6, wherein the receptacle-receiving portion comprises at least one ridge including an overhanging portion extending toward a central region of the carrier.

9. The assembly of claim 6, wherein the receptacle forms an interference fit with the receptacle-receiving portion of the carrier.

10. The assembly of claim 6, wherein the helmet accessory mounting interface is removably attached to the receptacle.

11. The assembly of claim 6, wherein the receptacle comprises a tab inserted into a slot of the helmet accessory mounting interface.

12. The assembly of claim 6, wherein a portion of the receptacle forms an interference fit with a corresponding portion of the helmet accessory mounting interface.

13. The assembly of claim 6, wherein the helmet accessory mounting interface is ready to receive a helmet accessory.

14. The assembly of claim 13, wherein the helmet accessory comprises a face shield, a visor, a camera or goggles.

15. The assembly of claim 6, further comprising the helmet, wherein the carrier is attached to a front portion of the helmet.

16. The assembly of claim 6, wherein the helmet accessory mounting interface comprises a metal plate.

17. A method of assembling a helmet accessory mount system, the system including a carrier which is attachable to a helmet and is configured to receive any type of receptacle from among a plurality of receptacle types, each type of receptacle being configured to receive a different type of helmet accessory mounting interface, the method comprising:

(a) selecting a type of receptacle to associate with the carrier from among a plurality of receptacle types, each type of receptacle being configured to receive a different type of helmet accessory mounting interface;

(b) attaching a receptacle of the selected receptacle type to the carrier;

(c) attaching an accessory mounting interface to the receptacle such that when the helmet accessory mounting interface, the receptacle, and the carrier are attached to the helmet, the helmet accessory mounting interface is located between the carrier and the receptacle; and (d) after (c), attaching a helmet accessory to the accessory mounting interface.

18. The method of claim 17, further comprising attaching the carrier to the helmet prior to attaching the receptacle to the carrier.

19. The apparatus of claim 1, wherein:

the accessory mounting interface includes an attachment hole; and the carrier, receptacle, and accessory mounting interface are arranged such that a fastener is insertable through the accessory mounting interface attachment hole and the receptacle to reach an attachment hole in the helmet.

20. The apparatus of claim 1, wherein the accessory mounting interface includes an attachment hole, and the receptacle and accessory mounting interface are coupled to one another and arranged such that a fastener is insertable into the mounting interface attachment hole from an accessory-facing side of the accessory mounting interface to attach the receptacle and accessory mounting interface to at least one of the carrier and the helmet.

21. The apparatus of claim 1, wherein the receptacle-receiving portion comprises an opening for attachment of the helmet accessory mounting interface to the helmet.

22. The apparatus of claim 1, wherein the receptacle-receiving portion is configured to receive any selected one of a plurality of receptacles.

23. The apparatus of claim 1, further comprising the helmet.

* * * * *